US006718712B1

(12) United States Patent
Heath

(10) Patent No.: US 6,718,712 B1
(45) **Date of Patent: *Apr. 13, 2004**

(54) STRUCTURAL PANEL AND METHOD OF FABRICATION

(76) Inventor: Mark David Heath, 24827 San Fernando Rd., Suite 137, Newhall, CA (US) 91321

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/539,818

(22) Filed: Mar. 31, 2000

Related U.S. Application Data

(60) Provisional application No. 60/127,224, filed on Mar. 31, 1999.

(51) Int. Cl.[7] ..... E04C 1/00; E04B 2/00; E04F 13/04

(52) U.S. Cl. ..... 52/309.12; 52/454; 52/368; 52/405.3; 52/DIG. 9

(58) Field of Search ..... 52/309.12, 454, 52/368, 405.3, DIG. 9, 745.19, 309.1, 309.8, 443, 364, 404.1, 405.1

(56) References Cited

U.S. PATENT DOCUMENTS

| | | | | | |
|---|---|---|---|---|---|
| 773,244 | A | * | 10/1904 | Brothers | 52/405.3 |
| 1,527,805 | A | * | 2/1925 | Leigh | 52/368 X |
| 3,232,017 | A | * | 2/1966 | Prusinski et al. | 52/309.9 |
| 4,079,560 | A | * | 3/1978 | Weismann | 52/309.12 X |
| 4,104,842 | A | * | 8/1978 | Rockstead et al. | 52/309.12 X |
| 4,125,981 | A | * | 11/1978 | MacLeod et al. | 52/309.12 |
| 4,226,067 | A | * | 10/1980 | Artzer | 52/309.12 |
| 4,253,288 | A | * | 3/1981 | Chun | 52/309.12 X |
| 4,297,820 | A | * | 11/1981 | Artzer | 52/309.12 X |
| 4,336,676 | A | * | 6/1982 | Artzer | 52/309.12 X |
| 4,454,702 | A | * | 6/1984 | Bonilla-Lugo et al. | 52/309.12 X |
| 4,505,019 | A | * | 3/1985 | Deinzer | 52/309.12 X |
| 4,611,450 | A | * | 9/1986 | Chen | 52/309.12 X |
| 4,669,240 | A | * | 6/1987 | Amormino | 52/309.12 X |
| 4,785,602 | A | * | 11/1988 | Giurlani | 52/309.12 |
| 5,058,345 | A | * | 10/1991 | Martinez | 52/309.12 X |
| 5,119,606 | A | * | 6/1992 | Graham | 52/309.11 X |
| 5,351,454 | A | * | 10/1994 | Hähne et al. | 52/309.17 |
| 5,398,470 | A | * | 3/1995 | Ritter et al. | 52/309.12 X |
| 5,440,845 | A | * | 8/1995 | Tadros et al. | 52/309.12 |
| 5,487,248 | A | * | 1/1996 | Artzer | 52/309.12 |
| 5,515,659 | A | * | 5/1996 | MacDonald et al. | 52/309.12 X |
| 6,061,986 | A | * | 5/2000 | Canada | 52/DIG. 9 X |
| 6,185,890 | B1 | * | 2/2001 | Ritter | 52/309.12 X |
| 6,226,942 | B1 | * | 5/2001 | Bonin | 52/309.12 |
| 6,244,008 | B1 | * | 6/2001 | Miller | 52/309.12 X |
| 6,272,805 | B1 | * | 8/2001 | Ritter et al. | 52/309.11 |

* cited by examiner

*Primary Examiner*—Jeanette E. Chapman
(74) *Attorney, Agent, or Firm*—Kelly, Bauersfeld, Lowry & Kelley, LLP

(57) ABSTRACT

Structural panels are provided which utilize commercially available components and a cost effective method of fabrication. The structural panels include commercially available trusses, fillers positioned between and aligned with the trusses and sandwiched to form a solid panel core, and commercially available wire mesh substantially covering opposing side surfaces of the panel core and attached to the trusses with wire to hold the panel core together. The trusses include generally parallel rods and wire bent around the rods in a zigzag configuration. The fillers may include a foamed filler such as solid foamed plastic or solid foamed glass. Alternatively, the filler may include a stabilized organic material. A commercially available lathing member may also be imbedded into the structural panel. The structural panels are fabricated by aligning the fillers and trusses in an alternating sequence. The alternating masonry reinforcement trusses and fillers are then pressed to form a panel core. The wire mesh is overlied on opposing side surfaces of the panel core and attached to the trusses by attaching metal ties to connection points of the wire mesh and trusses to hold the panel core together. A durable coating can then be applied to the panel core and attached wire mesh.

6 Claims, 3 Drawing Sheets

STRUCTURAL PANEL AND METHOD OF FABRICATION

RELATED APPLICATION

This application claims priority from provisional application Ser. No. 60/127,224 filed Mar. 31, 1999.

BACKGROUND OF THE INVENTION

The present invention relates generally to construction materials. More particularly, the invention concerns structural panels and methods for their manufacture which employ fillers comprised of solid foamed materials or stabilized organic materials, together with a reinforcing structure comprised of commercially available components, which when assembled and faced with a durable covering provides a building component.

Prefabricated structural building panels are utilized in the construction of structures such as houses and commercial, industrial and institutional buildings. They are also utilized in the construction of non-building structures such as retaining walls, fences, and cisterns. The pre-manufacturing of the panels allows for lower costs and faster construction than available with conventional, in-situ piecemeal construction.

Prefabricated structural panels are typically comprised of a filler medium reinforced with metal lattice structures and surrounded by a metal mesh or cage. A coating, such stucco, air blown cementitious mixtures or the like, is added to complete the building process. While these structural panels have been useful in the construction industry, they have had the disadvantage of being costly and sometimes unavailable in rural areas.

Lightweight plastic materials, including many different types of foamed synthetic resins and expanded plastic foams such as urethanes, polystyrenes, and the like, have a number of properties that are highly desired in building materials for various types of structures such as walls, roofs and the like, and these plastic materials have been the customary filler material utilized in structural panels. However, such materials are manufactured from petrochemical substances and have potential environmental damage issues associated with them. There is also the increasing price of these fillers due to the finite quantity of petroleum resources and their depletion. Additionally, there is the difficulty in obtaining plastic foams in developing countries and remote locations as well as the high cost of shipping to these locations due to plastic foam volume to weight ratio.

Companies which provide structural panels produce their own specialized metal lattice structures and metal meshes having various wire gauges and wire bends which deviate from industry standards. For example, industry standard masonry reinforcement trusses use a zigzag configuration having approximately thirty degree (30°) bends. At least one company produces lattice structures having forty-five (45°) bends for use in their structural panels, a configuration which is more structurally sound but which also increases the cost of the structural panel due to production costs. Typically, such structural panels are limited to only one thickness option. The wire gauges of the wire mesh are often altered at key structural points to reinforce the structural panel. While structurally superior, these designs result in increased expense passed to the end consumer. The design of the structural panel may also be complicated which further increases production costs. For example, the structural panel of U.S. Pat. No. 5,487,248 (incorporated by reference herein) utilizes preformed plastic foamed filler elements which create chambers when brought together for the later insertion of wires, pipes, etc., used within the building. In rural areas and foreign countries many of these specialized materials are not available and must be shipped, further increasing expense or prohibiting the area from using prefabricated structural panels altogether.

Accordingly, there is a need for a composite structural panel that utilizes commercially available components and tooling to reduce the costs associated therewith. What is also needed is a structural panel which incorporates filler mediums that are readily available or producible in rural areas. The present invention fulfills these needs and provides other related advantages.

SUMMARY OF THE INVENTION

The present invention relates to pre-fabricated structural panels which utilize commercially available materials, and a cost-efficient and simple method of construction. Accordingly, the main objective of this invention is a novel and improved structural panel which can be constructed in a wide variety of thicknesses, widths and lengths without dependence on limited source and costly materials.

The structural panels are generally comprised of a plurality of commercially available trusses, such as masonry reinforcement trusses, etc., and a plurality of fillers positioned between and aligned with the trusses. The fillers are sandwiched between the trusses to form a solid panel core. Commercially available wire mesh, substantially covering opposing side surfaces of the panel core, is attached to the trusses with metal ties to hold the panel core together.

In the preferred form of the invention, the trusses comprise substantially parallel rods having wire bent around the rods in a zigzag configuration at approximately thirty degree (30°) angles. The fillers may be comprised of a foamed filler such as solid foamed plastic or solid foamed glass. Alternatively, the filler is comprised of a stabilized organic material.

A commercially available lathing member may be imbedded into the structural panel for later attachment of drywall and the like.

To fabricate the structural panels, the fillers and trusses are first aligned in a alternating sequence. The alternating trusses and fillers are then pressed to form a panel core. The wire mesh is placed over opposing side surfaces of the panel core and attached to the trusses by attaching metal ties, such as bailing wire, to connection points of the wire mesh and trusses to hold the panel core together. A durable coating is later applied to the panel core and attached wire mesh.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
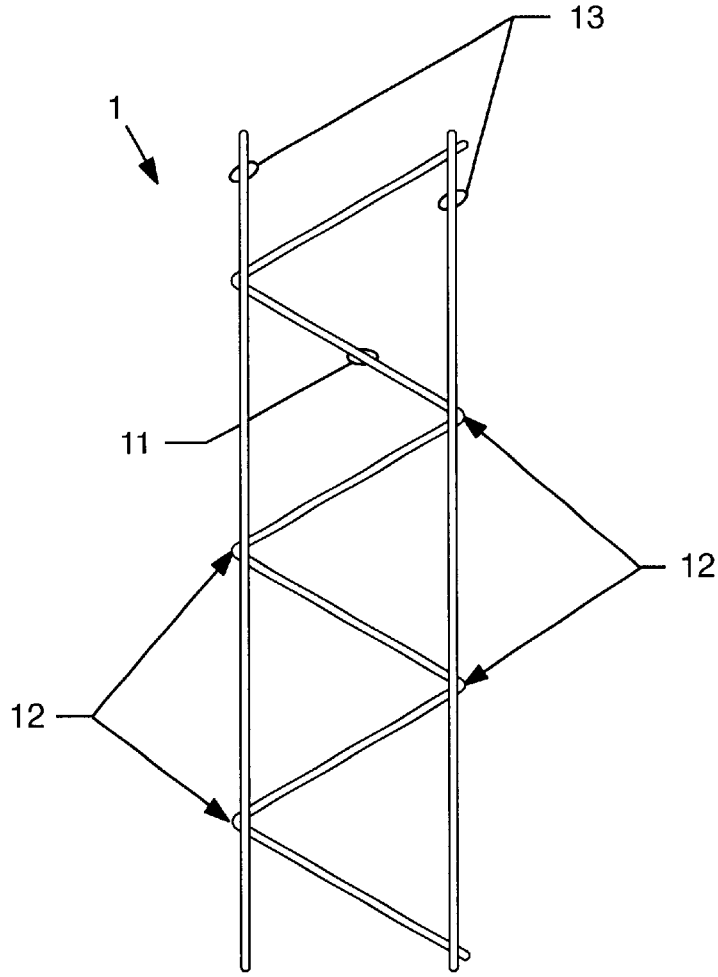
FIG. 1 PRIOR ART
FIG. 1 is an elevational view of a commercially available truss used in accordance with the present invention.

In accordance with the present invention, an exemplary commercially available truss 1 is illustrated in FIG. 1. The truss 1 generally comprises a wire 11 having a series of bends 12 around a pair of mutually spaced apart side rods 13. The rods 13 are laid in parallel fashion along the bends 12 of wire 11 and welded or otherwise attached to the wire 11 to provide a generally planar configuration. The trusses 1 are constructed and sold in varying widths which can be utilized for the creation of different thicknesses of structural panels. Such trusses 1 include commonly available masonry reinforcement trusses and space frame trusses, although other commercially available trusses may be used.

As is common in the industry, center wire 11 is bent in a zigzag configuration to provide strength to the truss. The angle of the bends 12 may be varied depending on structural loading imposed on the panel, for example masonry reinforcement trusses traditionally have approximately either 30° or 60° wire bends as shown in the drawings to form triangles within the trusses 1. Of course, other commercially available trusses may have different angles within the bent wire. The gauge of the side rods 13 and the bent wire 11 may be varied to resist varying loads. For example, a 10 gauge wire may be used for heavier load applications and a 12 gauge wire for lighter load applications. The side rods 13 and the bent wire 11 may be smooth wire or deformed. The use of deformed wire creates greater mechanical adhesion between said wires and a cementitious coating 5 as will be further described.

Figure 2:
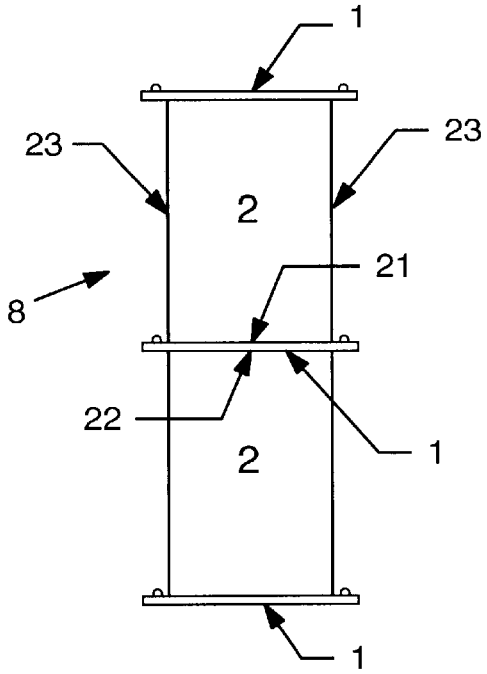
FIG. 2 is an elevational view of a panel core having alternating trusses and fillers.
Figure 3:
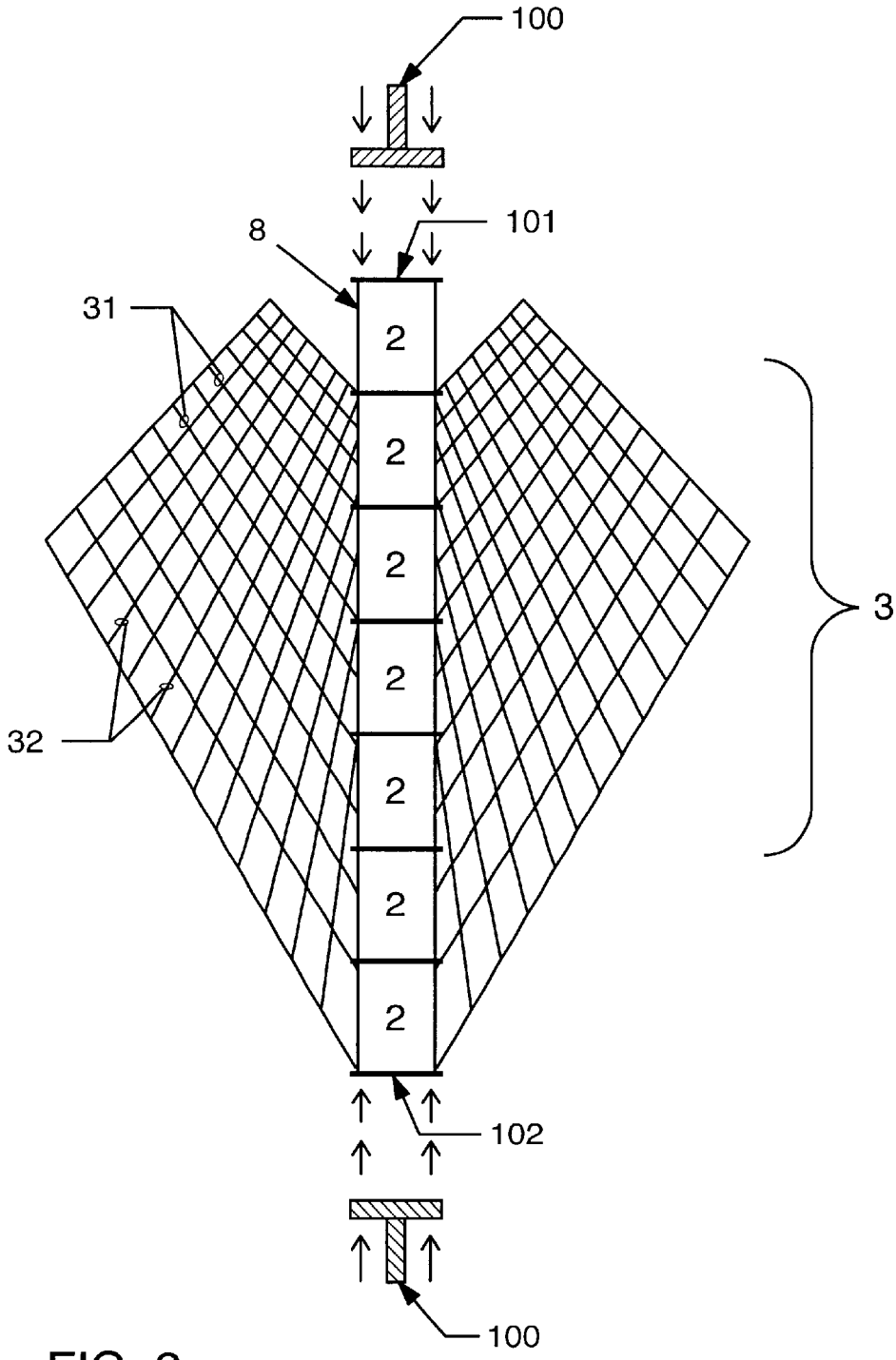
FIG. 3 is a schematic view illustrating the positioning of a wire mesh adjacent to opposing side surfaces of the panel core of FIG. 2 after compressing the panel core.
Figure 4:
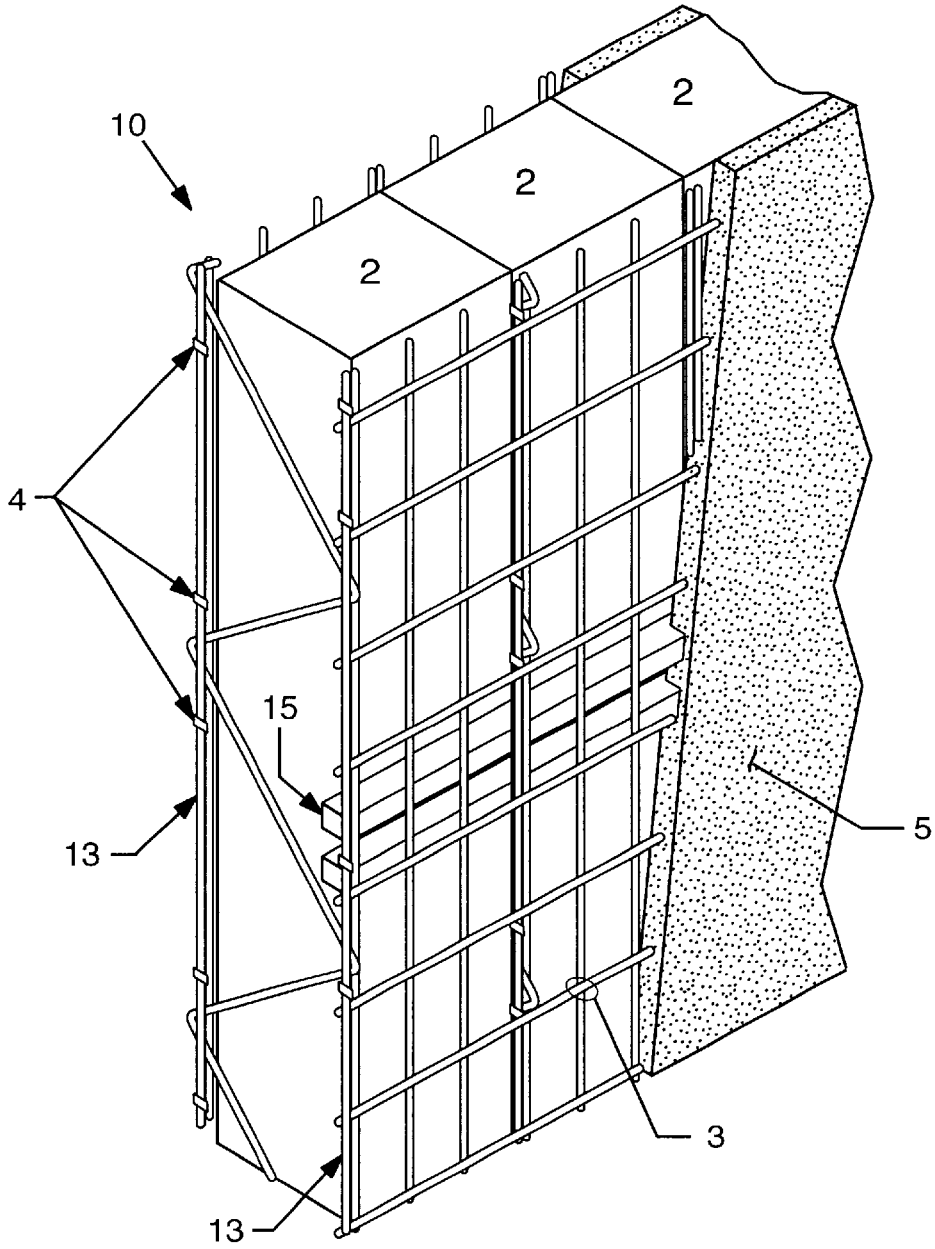
FIG. 4 is a partly fragmented perspective view of a fabricated structural panel embodying the present invention and having a durable coating applied thereto.

As shown in FIGS. 2 through 4, a panel core 8 of the structural panel 10 of this invention includes a plurality of elongated filler members 2 in face-to-face contact at surfaces 21 and 22 with the trusses 1 interdigitated with the filler members 2. The plurality of elongated filler members 2 lie in a mutually contiguous arrangement. Between opposed surfaces 21 and 22 of the filler members 2 are alternatingly placed trusses 1 of the type shown in FIG. 1 and aligned with the filler members 2. Each elongated filler member 2 has opposite side surfaces 23 extending generally normal to said opposed surfaces 21 and 22 as shown in FIG. 2. A rectilinear cross-section is the norm but not necessary. Trapezoidal shapes would allow for the construction of curvilinear panels.

The filler members 2 can be of a solid foamed type, such as solid plastic foamed material or glass foamed material. The elongated filler members 2 may also be made from a variety of organic materials comprising agricultural waste or biomass, such as straw or wood chips hammer milled or otherwise broken and added to a stabilizer such as cement. The primary requirement is that the finished organic filler element have sufficient physical strength to be useful over the period of time of manufacture and erection of the panels and resist the stresses of the application of the cementitious covering 5. The stabilizer should prevent the environment, insects, rodents and the like, from eating away or degrading the organic material. The foamed material or stabilized organic material is made into the required shape and dimensions to form a panel core sub-assembly. The organic material filler member 2 can be blown into plastic bags or combined with a polymer and poured, extruded or otherwise formed into free standing members as is known in the art.

The use of an organic filler material in the form of biomass or agricultural waste instead of the plastic filler material of prior art allows for the panels to be made more readily in areas where plastic filler materials are not readily available or cost prohibitive. Wood chip concrete is a common material which could be employed as the filler material, however other organic materials which could be formed in the requisite shape would serve to accomplish the desired panel configuration. Examples include corn stocks, bamboo, kenaf, rice hulls, rice straw, orchard thinnings, grain straw, shredded paper, scrub brush, or any organic fibrous material (i.e. biomass or agricultural waste) which could be formed into the needed shape. The organic filler material can be formed to size or can be formed in panels or blocks of larger sizes for efficiency of manufacture and then cut to size. In addition to utilizing cement as a binder for the organic material, the use of plastic additives such as recycled PET bottles, the use of recycled tires, the use of asphalts, adhesives or binders generated by the plants under imposed conditions such as steam and pressure, can all be utilized to form the organic material into shapes which can be employed in the fabrication of the structural panels 10.

As shown in FIG. 3, lateral compressive pressure is applied to the layered filler members 2 and trusses 1 by a suitable press 100. Thus, the trusses 1 are sandwiched between the opposed surfaces 21 and 22 of each filler member 2 to form a solid core 8. Preferably, the resultant structure is a plurality of filler members 2 stacked together wherein the opposed surfaces 21 and 22 are held tightly together with the layers of trusses 1 imbedded in surfaces 21 and 22. However, only sufficient pressure to allow for the application of the wire mesh 3 is required. Where less pressure is applied such that the completed panel is not rigid of itself, a straightening rod (not shown) may be temporarily applied in the field, so that sufficient rigidity is available for the application of the coating 5. Having a less rigid core panel 8 can also present some application advantages where curvilinear structures are desired. While the norm is for the press 100 to be a mechanical apparatus, it may be sufficient to have the press be nothing more than hand pressure. The press does not need to be bi-directional. There may be sufficient compression achieved with pressure generated from one side 101 of the stacked members against a fixed surface on the opposite side 102 of the stack.

A wire mesh 3, formed of lateral wires 31 and longitudinal wires 32, is laid against the side surfaces of the pressed core of trusses 1 and filler members 2 and attached to the rods 13 with commercially available metal ties 4, such as upholstery C-clamps, concrete reinforcement wires, or bailing wire cut to an appropriate length. The ties 4 are attached by hand, pliers or other appropriate tools. The wire mesh 3 is preferably applied to both sides of the trusses 1 so that the resulting structural panel contains filler members 2 interdigitated with trusses 1, with overlays of wire mesh 3 on both sides. The wire mesh 3 can be comprised of a wire netting, such as chicken wire as is commonly used in plastering applications, as well as the pre-manufactured wire netting assemblies such as k-lath. Other commercially available wire meshes 3 may also be used as suits the demands of the structure to be built. These commercially available wire meshes 3 are typically of a single gauge of wire in both the latitudinal 31 and longitudinal 32 directions. In some cases, however, the latitudinal wire 31 will be of one gauge while the longitudinal wire 32 will be of a different gauge.

Commercially available lathing members 15 such as metal sheets or furring channels may be added to the structural panel 10, typically within the wire mesh 3, to act as a secure anchor for later attachment of a finished board such as drywall, gypsum board or the like.

In use, the structural panel 10 of this invention is arranged horizontally or vertically, depending on the loads being imposed. The structural panel 10 can be employed in the construction of structures by itself or it may be integrated with other building materials. Some examples would be: (1) employ the structural panel 10 in the construction of roofs on masonry or adobe walls; (2) the construction of in-fill walls in steel or concrete post-and-beam framed structures; (3) the construction of floors in the aforementioned construction types; (4) retaining walls; (5) fences; and (6) hardscape features such as tables and benches. By selecting trusses 1 of differing wire 11 or rod 13 gauge, or by changing the gauge of the wires 31 and/or 32 in the wire mesh 3, the strength of the structural panel 10 can be varied. Additionally, multiples of trusses 1 or multiple layers of wire mesh 3 may be used to vary the strength of the structural panel 10.

After the completed structural panel 10 is erected to form the desired structure or building, it is then covered with a cementitious coating 5 resulting in a hard, durable and substantially planar finished surface. The norm is for this coating 5 to be a sand-cement plaster mix but it could be any of the air-placed cementitious materials (shotcrete, gunnite, etc.) or could be an adobe material. Additionally, modern coating materials such as hybrid concretes, glass fiber reinforced concrete, cement-plastic, or foamed concrete materials could all be employed to meet specialized or customized needs. It is also possible to pre-cast the coatings 5 on the structural panels 10 and then erect the pre-coated structural panels. The structural panels 10 can also be used to create an insulating and reinforcing core in form-and-pour concrete or form-and-pour earthen systems.

The primary advantage of the present invention is that the components of the structural panel are widely available, even in rural areas or foreign countries, which dramatically reduces the costs associated with the prefabricated structural panels. Particularly in third world countries, organic materials as described above which would otherwise be disposed of can be used in the construction of buildings and other structures.

Although several embodiments have been described in detail for purposes of illustration, various modifications may be made without departing from the scope and spirit of the invention. Accordingly, the invention is not to be limited, except as by the appended claims.

What is claimed is:

1. A pre-fabricated structural panel, comprising:

a plurality of commercially available trusses having substantially parallel rods of identical width interconnected by wire bent around the rods in a zigzag configuration;

a plurality of solid foamed glass fillers positioned between and aligned with the trusses and sandwiched therebetween under pressure to form a solid panel core;

commercially available wire mesh substantially covering opposing side surfaces of the panel core and attached to the rods of the trusses with commercially available metal ties to hold the panel core together; and a commercially available lathing member imbedded within the structural panel wherein said lathing member acts as a secure anchor for attachment of at least one finished board.

2. The structural panel of claim 1, wherein the trusses comprise masonry reinforcement trusses having wire bent around the rods at approximately 30° angles.

3. The structural panel of claim 1, including a durable coating overlying the panel core and attached wire mesh.

4. A pre-fabricated structural panel, comprising:

a plurality of commercially available trusses having substantially parallel rods of identical width interconnected by wire bent around the rods in a zigzag configuration;

a plurality of fillers comprised of stabilized biomass positioned between and aligned with the trusses and sandwiched therebetween to form a panel core;

commercially available wire mesh substantially covering opposing side surfaces of the panel core and attached to the rods of the trusses with commercially available metal ties to hold the panel core together; and a commercially available lathing member imbedded within the structural panel wherein said lathing member acts as a secure anchor for attachment of at least one finished board.

5. The structural panel of claim 4, wherein the trusses comprise masonry reinforcement trusses having wire bent around the rods at approximately 30° angles.

6. The structural panel of claim 4, including a durable coating overlying the panel core and attached wire mesh.

* * * * *